US010053804B2

(12) United States Patent
Frantz et al.

(10) Patent No.: US 10,053,804 B2
(45) Date of Patent: Aug. 21, 2018

(54) UNDERWEAR FOR MEN

(71) Applicant: HBI Branded Apparel Enterprises, LLC, Winston Salem, NC (US)

(72) Inventors: Adam Frantz, Winston Salem, NC (US); Tasha Perry, Winston Salem, NC (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 377 days.

(21) Appl. No.: 14/706,717

(22) Filed: May 7, 2015

(65) Prior Publication Data

US 2015/0320118 A1 Nov. 12, 2015

Related U.S. Application Data

(60) Provisional application No. 61/996,442, filed on May 7, 2014.

(51) Int. Cl.

| | |
|---|---|
| ***D04B 1/24*** | (2006.01) |
| ***A41B 9/02*** | (2006.01) |
| ***D04B 1/10*** | (2006.01) |

(52) U.S. Cl.

CPC ..... *D04B 1/243* (2013.01); *A41B 9/02* (2013.01); *D04B 1/108* (2013.01)

(58) Field of Classification Search

CPC ..... D04B 1/243; D04B 1/26; D04B 1/265; D04B 9/42; D04B 9/46

See application file for complete search history.

(56) References Cited

U.S. PATENT DOCUMENTS

| | | | | | |
|---|---|---|---|---|---|
| 2,000,073 | A * | 5/1935 | Goas | A41B 9/001 | 2/407 |
| 2,255,931 | A * | 9/1941 | Kloster | A41B 9/02 | 2/404 |
| 2,623,210 | A * | 12/1952 | Chatfield | A41B 9/02 | 2/403 |
| 2,636,368 | A * | 4/1953 | Anderson | D04B 1/243 | 66/174 |
| 2,717,388 | A * | 9/1955 | Rutledge | A41B 9/02 | 2/401 |
| 3,283,545 | A * | 11/1966 | Simon | A41B 9/02 | 2/403 |

(Continued)

FOREIGN PATENT DOCUMENTS

| | | |
|---|---|---|
| CN | 102669825 | 9/2012 |
| WO | WO2010020547 | 2/2010 |

OTHER PUBLICATIONS

PCT International Search Report and Written Opinion of the International Searching Authority, PCT/US2015/029749, dated Jul. 27, 2015, 14 pages.

(Continued)

*Primary Examiner* — Danny Worrell

(74) *Attorney, Agent, or Firm* — Fish & Richardson P.C.

(57) ABSTRACT

An undergarment includes a body having a substantially tubular shape and configured to at least partially surround a torso of a user. The body includes a pouch region about a front surface of the body, and a stitch region including held stitches, the held stitches at least partially bordering the pouch region, and the stitch region having less lateral stretch than a remainder of the body.

23 Claims, 3 Drawing Sheets

(56) References Cited

U.S. PATENT DOCUMENTS 3,312,981 A * 4/1967 McGuire ..... A61F 13/72 2/406
3,946,579 A * 3/1976 Heinig ..... A41B 9/004 66/177
3,956,909 A * 5/1976 Negri ..... D04B 1/243 66/177
4,527,403 A * 7/1985 Fullbright ..... A41B 9/001 2/401
4,722,202 A * 2/1988 Imboden ..... A41B 9/004 2/401
4,811,427 A * 3/1989 Regan ..... A63B 71/12 2/227
5,131,100 A * 7/1992 Atwater ..... A41B 9/02 2/400
5,590,548 A * 1/1997 Osborne ..... A41B 9/04 2/401
5,787,512 A 8/1998 Knox
5,823,013 A * 10/1998 Lonati ..... D04B 1/243 66/176
6,041,441 A * 3/2000 Counts ..... A41D 1/08 2/227
6,192,717 B1 * 2/2001 Rabinowicz ..... D04B 1/243 66/171
6,622,312 B2 * 9/2003 Rabinowicz ..... A41C 3/0014 2/274
7,100,213 B2 * 9/2006 Krautbauer ..... A41B 9/023 2/400
7,155,940 B1 * 1/2007 Imboden ..... D04B 1/243 66/177
7,260,961 B1 * 8/2007 Kennedy ..... D04B 1/243 66/171
7,441,418 B2 * 10/2008 Delgado-Mecinas .... A41B 9/00 66/169 R
7,526,929 B2 * 5/2009 Takamoto ..... A41D 13/0015 66/177
7,559,216 B2 * 7/2009 Imboden ..... A41B 11/14 66/177
7,997,102 B2 * 8/2011 Obadalova ..... D04B 1/108 66/177
8,336,120 B2 * 12/2012 Wong ..... A41B 9/02 2/238
2008/0178369 A1 7/2008 Kitsch
2009/0293549 A1 * 12/2009 Lonati ..... D04B 1/24 66/175
2010/0132411 A1 * 6/2010 Ando ..... D04B 1/243 66/178 R
2015/0247706 A1 * 9/2015 Freier ..... F41H 1/02 2/2.5
2015/0296891 A1 * 10/2015 Blibech ..... A41B 9/001 2/400

OTHER PUBLICATIONS

Chinese Office Action in Chinese Application No. 201580023333.9 (with machine English translation), dated Nov. 4, 2017, 21 pages.

* cited by examiner

UNDERWEAR FOR MEN

CROSS-REFERENCE TO RELATED APPLICATIONS

This application claims the benefit of U.S. Provisional Application No. 61/996,442, filed May 7, 2014.

TECHNICAL FIELD

This disclosure relates to undergarments, for example, men's undergarments or underwear.

BACKGROUND

Undergarments exist in a number of forms, such as men's boxer shorts, men's briefs, and the combination boxer brief. Each style provides a different combination of fit, comfort, and support. During exercise or other athletic activity, discomfort can result from movement of the male anatomy when insufficiently supported by one's underwear. During everyday wear, discomfort may result in undergarments that unintentionally shift on the body, or areas of fabric that may tend to bunch together.

SUMMARY

This disclosure describes underwear for men.

In some aspects, an undergarment includes a body having a substantially tubular shape and configured to at least partially surround a torso of a user. The body includes a pouch region about a front surface of the body, and a stitch region including held stitches, the held stitches at least partially bordering the pouch region, and the stitch region having less lateral stretch than a remainder of the body.

This, and other aspects, can include one or more of the following features. The body can be formed from a circularly knit tubular blank. The stitch region can include a first stitch area along a periphery of the pouch region and a second stitch area between the pouch region and the first stitch area, where the second stitch area includes the held stitches and has less lateral stretch than the first stitch area. The first stitch area can include an outer stitch area and an inner stitch area, the inner stitch area having less lateral stretch than the outer stitch area. The outer stitch area can include a first rib structure, and the inner stitch area can include a second, wider rib structure. The first rib structure of the outer stitch area can include a 1×14 rib structure, and the second rib structure of the inner stitch area can include a 4×1 rib structure. The second stitch area can include a pattern of the held stitches to form fabric gathers in the pouch region adjacent the second stitch area. The body can include a first tubular leg portion and a second tubular leg portion substantially parallel to the first tubular leg portion, the first and second leg portions extending toward a first end of the body. The first tubular leg portion can include a first leg band knit into the first tubular leg portion at the first end of the body, and the second tubular leg portion can include a second leg band knit into the second tubular leg portion at the first end of the body. The undergarment can include a waistband attached to the body at a second end of the body opposite the first end. The undergarment can include a crotch piece sewn along inner slits of the first and second tubular leg portions and at least partially sewn along the stitch region and the pouch region. The stitch region can include a third stitch area between the crotch piece and the pouch region. The third stitch area can include a 1×1 rib structure.

Some aspects of the subject matter described herein can be implemented as a method of making an undergarment. The method includes circularly knitting a tubular blank to form a body of an undergarment. The body includes a pouch region about a front surface of the body, and a stitch region including held stitches, the held stitches at least partially bordering the pouch region, and the stitch region having less lateral stretch than a remainder of the body.

This, and other aspects, can include one or more of the following features. Circularly knitting a tubular blank to form a body of the undergarment can include selectively varying a stitch pattern in the stitch region to form a first stitch area along a periphery of the pouch region and a second stitch area between the pouch region and the first stitch area, the second stitch area including the held stitches and having less lateral stretch than the first stitch area. Circularly knitting a tubular blank to form a body of the undergarment can include selectively varying a stitch pattern in the stitch region to form the held stitches at least partially bordering the pouch region, the held stitches configured to create fabric gathers in the pouch region. Circularly knitting a tubular blank can include circularly knitting a tubular blank beginning with a welt on a first end of the tubular blank, and the method can further include cutting a pair of slits in the tubular blank, the slits cut on opposite circumferential locations of the tubular blank and extending longitudinally from the first end of the tubular blank, circularly knitting a second tubular blank, beginning and ending with a welt, cutting a portion of the second tubular blank spanning a length of the second tubular blank to form a crotch piece, the crotch piece including welted ends, and sewing the crotch piece onto slit edges of the first mentioned tubular blank to form two leg portions.

Some aspects of the subject matter described herein can be implemented as a method of at least partially manufacturing an undergarment, the method including circularly knitting a first tubular blank beginning with a welt at a first end of the first tubular blank, cutting a pair of slits into the first tubular blank, the slits cut on opposite circumferential locations of the first tubular blank and extending from the first end of the first tubular blank partially along a longitudinal length of the first tubular blank, circularly knitting a second tubular blank beginning and ending with a welt at a first longitudinal end and a second longitudinal end of the second tubular blank, cutting a crotch piece from the second tubular blank, the crotch piece being a segment of the second tubular blank and extending from the welt at the first longitudinal end to the welt at second longitudinal end, and sewing the crotch piece onto slit edges of the first tubular blank to create two leg openings, where the welts on the first and second longitudinal ends of the crotch piece align with the welt on the first end of the first tubular blank.

This, and other aspects, can include one or more of the following features. The method can further include attaching a waistband to the first tubular blank opposite the leg openings. Circularly knitting the first tubular blank can include selectively varying a stitch pattern of the first tubular blank to create a pouch at least partially bordered by an area of held stitches.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes undergarments for men, for example, undergarments to support a male anatomy during movement (e.g., everyday activity, exercise, and/or other) of a user of the undergarment. An undergarment includes seamless regions of fabric with varying stretchability, for example, to support a male anatomy by selectively limiting the stretch of select regions of fabric of the undergarment. In some instances, a supportive undergarment includes a circular-knit undergarment. Circular knitting is a conventional knitting technique that creates tubular blanks of knitted fabric. The blanks can be subjected to one or more finishing processes to complete a garment. Circular knitting equipment can be used to produce an undergarment. For example, the Santoni Company has developed several circular knitting machines that have increased the ability to knit tubular blanks with larger and larger diameters. In some instances, by using circularly knit blanks, the number of separate fabric pieces that are sewn together when forming a finished garment can be decreased. As a result, garments can be created with significantly reduced numbers of seams. By reducing the number of fabric pieces and seams, garments can be both more comfortable for the wearer and more cost-effective to manufacture.

Figure 2:
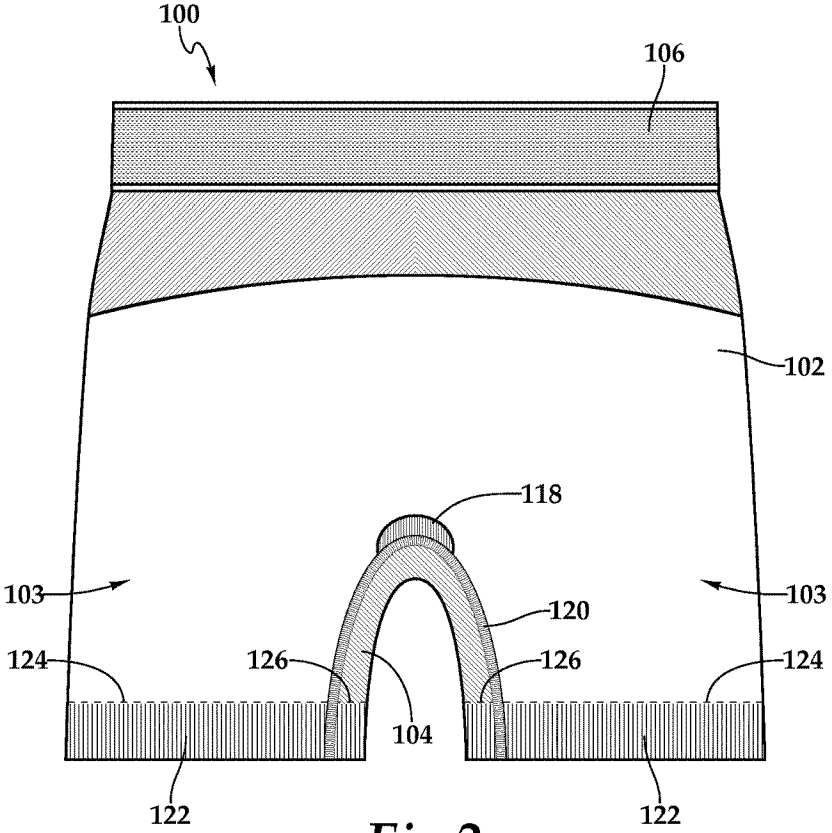
FIGS. 1 and 2 are a front view and a rear view of an example undergarment.
Figure 1:
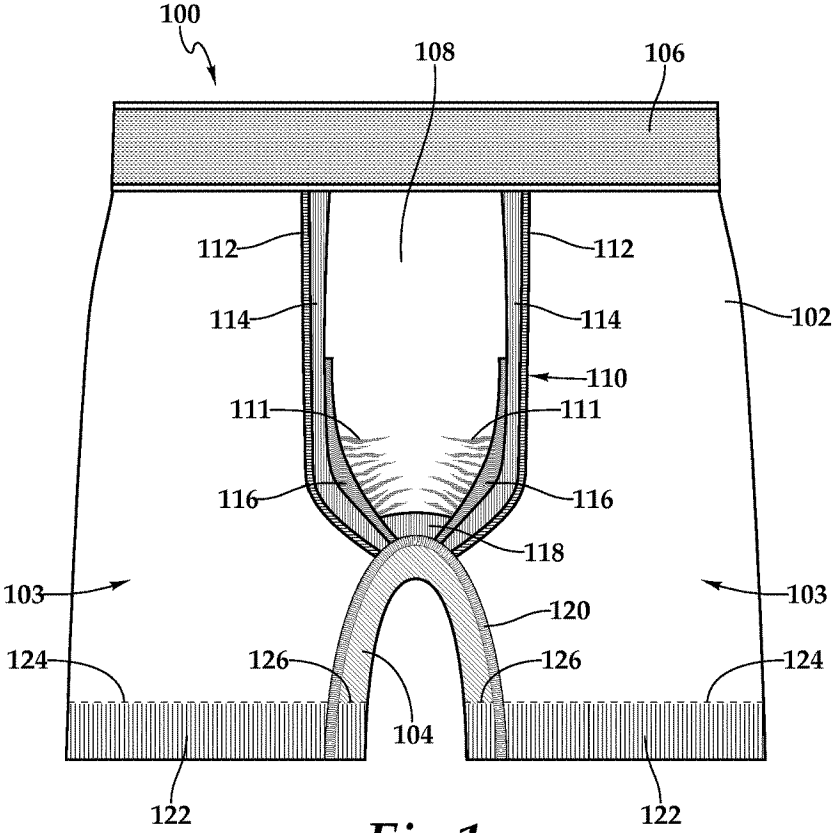

FIGS. 1 and 2 are a front view and a rear view, respectively, of an example undergarment 100. The example undergarment 100 is shown as a mid-thigh boxer brief style undergarment. However, the example undergarment 100 can take on a variety of styles (e.g., briefs, boxers, trunks, low-thigh, and/or other). The example undergarment 100 includes a substantially seamless body 102, a crotch piece 104 sewn to the body 102 to form leg portions 103 at a first end of the body, and a waistband 106 connected (e.g., adhered, sewn, and/or other) to the body at a second end of the body 102 opposite the first end. The body 102 has a substantially tubular shape and at least partially surrounds a torso of a user of the example undergarment 100 at the second end of the body 102. At the first end of the body 102, the crotch piece 104 spans between the leg portions 103 to provide each of the leg portions 103 with a substantially tubular shape. In the present disclosure, a longitudinal direction can be defined as a direction extending substantially between the first end and second end of the body 102 (i.e., between the waistband 106 and the leg portions 103 along the body 102). Similarly, a lateral direction can be defined as a direction extending substantially perpendicular to the longitudinal direction along, or tangential to, a surface of the body 102.

In some instances, the body 102 is formed from a first circularly knit blank, and the crotch piece 104 is cut from a second, different circularly knit blank. The example undergarment 100 can be generally formed by slitting the first circularly knit blank, or body 102, at two opposite positions around the circumference of the first end, each slit extending longitudinally along a portion of the length of the first blank (i.e., from the first end of the body 102). The crotch piece 104 is sewn along the slit edges in the body 102, or first blank, to form the two separate leg portions 103 each having a leg opening at the first end of the body 102. The second end of the body 102, opposite the leg openings, can attach to the waistband 106, for example, by sewing, adhering, and/or other methods. In some instances, the waistband 106 is formed as part of the first circularly knit blank. In some examples, the waistband 106 includes an elastic waistband.

The example undergarment 100 of FIGS. 1 and 2 can be used by males. As such, the body 102 of the example undergarment 100 includes a pouch 108 integrally knit with the body 102, for example, during a circular knitting process of the first tubular blank. In some instances, the pouch 108 includes an opening, for example, created by an overlap of a separate piece of fabric of the pouch. The body 102 includes the pouch region 108 about a front surface (e.g., center front) of the body 102 and a stitch region 110 bordering (partially, substantially, or completely) the pouch region 108 and integrally knit into the first tubular blank. The stitch region 110 includes selectively chosen stitch patterns varying within the stitch region 110 that provide stretch limitations (e.g., in the lateral and/or longitudinal directions) in areas within the stitch region 110, for example, to support a male anatomy within the pouch region 108 during movement when the undergarment 100 is being worn by a male user. The stitch region 110 includes a pattern of held stitches bordering a portion of the pouch region 108. The pattern of held stitches forms fabric gathers 111 (e.g., extra body fabric, fabric folds, fabric wrinkles, and/or other forms of gathers) in the pouch region 108 that allow space for the male anatomy of a wearer of the undergarment 100. Although FIG. 1 shows the fabric gathers 111 as substantially about an end and on lateral sides of the pouch region 108, the fabric gathers 111 can extend (partially, substantially, or completely) across a width of the pouch region 108 and/or extend along a different or greater longitudinal length of the pouch region 108.

The stitch region 110 of the example undergarment 100 includes a first stitch area along a periphery of the pouch region 108. The first stitch area extends around the pouch 108 in a general U-shape from the waistband 106 toward the crotch piece 104. The first stitch area provides the general two-dimensional shape to the pouch region 108 in a front plan view of the undergarment 100 (e.g., the front view of the undergarment in FIG. 1). The first stitch area has less stretch than a remainder of the body 102, for example, due to a narrower knitting structure compared to a knitting structure of the remainder of the body. For example, the body 102 of the example undergarment can be primarily a plain or jersey knit structure. The pouch region 108 is delineated from the remainder of the body 102 by the stitch region 110 that separates the jersey pattern of the main body 102 from the jersey pattern within the pouch region 108. While the body 102 is described as primarily jersey knit, other patterns can be used to form the majority of the undergarment 100.

In the example undergarment 100 of FIG. 1, the first stitch area includes an outer stitch area 112 and an inner stitch area 114, with the inner stitch area 114 having less stretch than the outer stitch area 112. In some instances, the inner stitch area 114 and outer stitch area 112 include different rib structures, for example, the inner stitch area 114 can have a wider rib structure that the outer stitch area 112. In some examples, the inner stitch area 114 includes a 4×1 rib structure, and the outer stitch area 112 includes a 1×1 rib structure. The stitch region 110 also includes a second stitch area 116 between the pouch region 108 and the first stitch area, and the second stitch area 116 includes the pattern of held stitches that form the fabric gathers 111 in the pouch region 108. The second stitch area 116 has less stretch than the first stitch area (i.e., less stretch than the outer stitch area 112 and inner stitch area 114), for example, due to a wider rib structure of the second stitch area 116. The rib structures of the inner stitch area 114, outer stitch area 112, and/or second stitch area 116 of the stitch region 110 can vary, for example, based on a desired stretch of the area. In the example undergarment 100 of FIGS. 1 and 2, the varying rib structures of the outer stitch area 112, inner stitch area 114, and the second stitch area 116 create a stretch pattern that progressively decreases in lateral stretch from an outer edge of the stitch region 110 (e.g., the outer stitch area 112) to an inner edge of the stitch region 110 (e.g., the second stitch area 116) adjacent the pouch region 108. In some instances, the direction of stretch limitation for each of the areas of the stitch region 110 varies by area, for example, in a direction of stretch limitation. For example, the outer stitch area 112 and inner stitch area 114 can limit stretch in a substantially lateral direction, whereas the second stitch area 116 limits stretch in a substantially longitudinal direction.

The rib knit structures of the inner stitch area 114, outer stitch area 112, and second stitch area 116 alter the lateral stretch of the body 102 of the example undergarment 100 as compared to the jersey knit portions of the remainder of the body 102 and the pouch region 108. For example, the ribbed inner and outer stitch areas 114 and 112 have increased recovery force (e.g., elastic recovery, elastic return, stretch return, rigidity, and/or other force) in the course direction (i.e., lateral direction) compared to jersey knit portions because the stitch pattern floats across some of the needles. The fabric gathers 111, which at least partially provide the three-dimensional shape of the pouch region 108, are facilitated or otherwise at least partially provided or defined by the second stitch area 116. The second stitch area 116 adds support to the example undergarment 100 to help limit side-to-side (i.e., lateral) movement of the male anatomy, for example, during athletic activity of a user wearing the example undergarment 100. The limited stretch in the stitch region 110 of the body 102 increases side-to-side support based on the hold stitches in the second stitch area 116. In some instances, the held loops of the held stitches in the second stitch area 116 are held for between three and six courses. The held loops of the held stitches can be created in combination with a rib pattern of the second stitch area 116. In other words, the second stitch area 116 can have a base rib pattern while also holding some of the loops for several courses to form the held stitches. The held loops in the second stitch area 116 provide a portion of even more stretch resistance. In certain instances, the undergarment 100 can be considered as having several zones of stretchability, where a majority of the body 102 has a first stretch A, the outer stitch area 112 having a second stretch B, the inner stitch area 114 having a third stretch C, and the second stitch area 116 having a fourth stretch D, where A>B>C>D.

The stitch region 110 can include additional or different features. For example, the stitch region 110 of the example undergarment 100 of FIGS. 1 and 2 include a third stitch area 118 between the crotch piece 104 and the pouch region 108. In FIGS. 1 and 2, the third stitch area 118 is formed at the very bottom of the pouch region 108 adjacent to a seam 120 connecting the body 102 and the crotch piece 104. In some instances, the third stitch area 118 provides a run guard function (e.g., to prevent fabric running) by including a rib pattern, such as 1×1, similar to the outer stitch area 112, or other suitable stitch pattern. The third stitch area 118 can contribute to the three-dimensional shape of the pouch region 108 and the level of support the stitch region 110 provides to the pouch region 108. In some examples, the ribs of the third stitch area 118 also shape the body 102 to allow a smoother transition to the crotch piece 104 and the curved shape at the intersection of the pair of leg portions 103. In certain instances, such as shown in FIG. 2, the third stitch area 118 is similarly located along the arc of the seam 120 on the rear of the example undergarment 100. In some instances, the third stitch area 118 includes a rib pattern that limits stretch in the longitudinal direction, as compared to the rib patterns of the first and second stitch area 116 that limits stretch in a lateral direction.

The leg portions 103 of the example undergarment 100 each include a leg band 122 at the first end of the body 102. The leg bands 122 can be created with a rib knit pattern, for example, to resist stretch (i.e., lateral stretch) and provide increased power, or contraction force, as compared to the jersey knit of the majority of the body 102. This increase in power can help the leg band 122 resist movement along a wearer's leg to prevent the undergarment 100 from bunching. At least a portion of each leg band 122 is created integrally with the first tubular blank forming the body 102. The remainder of each leg band 122 may be created integrally with the second blank used for the crotch piece 104. The integral portion of each leg band 122 is created as a welt during the circularly knitting process. Each welt (i.e., leg band 122) includes a double layer of fabric resulting from knitting a first layer that is turned over and knit onto a second layer, the second layer continuing to form the remainder of the blank.

A welt can be formed on each longitudinal end of a circularly knit blank, however a welt that is knit into the starting end of the blank can produce a cleaner, smoother junction where the two layers of fabric meet. For this reason, conventional seamless garments made from tubular knit blanks have typically been knit waistband end first such that a primary junction is at the waistband end and a secondary junction, if any, is at a leg band end. In the example undergarment 100 of FIGS. 1 and 2, which includes a waistband 106 at the second end of the undergarment 100, a first welt of the first circularly knit blank (i.e., at the first end of the body 102) is used as portions of the leg bands 122, where a primary junction 124 of the first tubular blank is at the first end of the body 102, as opposed to the second end of the body 102 proximate the waistband 106. In effect, the example undergarment 100 of FIGS. 1 and 2 is knit upside down compared to conventional undergarments. As a result of knitting the undergarment 100 upside down, the undergarment 100 is better held in place on a wearer at the leg bands 122 of the leg portions 103 because more power is available to the leg bands 122. Further, comfort is improved at the leg bands 122 because excess trim-off, which tends to roll and curl, is minimized since the primary junction 124 is along the leg bands 122 of the body 102.

The leg bands 122 also include a crotch junction 126 along the portion of the leg bands 122 within the crotch piece 104. Since the crotch piece 104 is formed from a second circularly knit blank with welts on both ends of the second circularly knit blank, the crotch piece 104 includes a first welt on a first end with a primary junction and a second welt on a second, opposite end with a secondary junction. Thus, the crotch junction 126 on one of the leg bands 122 is a primary junction (i.e., first knitted welt) and the crotch junction 126 on the other of the leg bands 122 is a secondary junction (i.e., second knitted welt). The seam 120 connects the portions of the leg bands 122 formed from the welt of the first tubular blank (i.e., body 102) to the portions of the leg bands 122 formed from the welts of the second tubular blank (i.e., crotch piece 104). Trim-off can be present at the crotch junction 126 associated with the primary and/or secondary junction of the crotch piece 104. Trim-off is minimized for the entire example undergarment 100 because trim-off is only present in the small circumferential portion of a single leg band 122 associated with the secondary junction of the crotch piece 104. In some instances, trim-off is not present around any portion of the primary junction of the crotch junction 126. In some instances, circular knit blanks can be knit with welts formed on each end, but only the first end's welt is formed free from trim-off.

The example undergarment 100 can be knit of an elastomeric or stretch knitted fabric. Such fabrics can be made by varying combinations of cotton, polyester, nylon, and/or spandex yarns, for example, to provide softness, comfort, and desired stretch properties.

Figure 3:
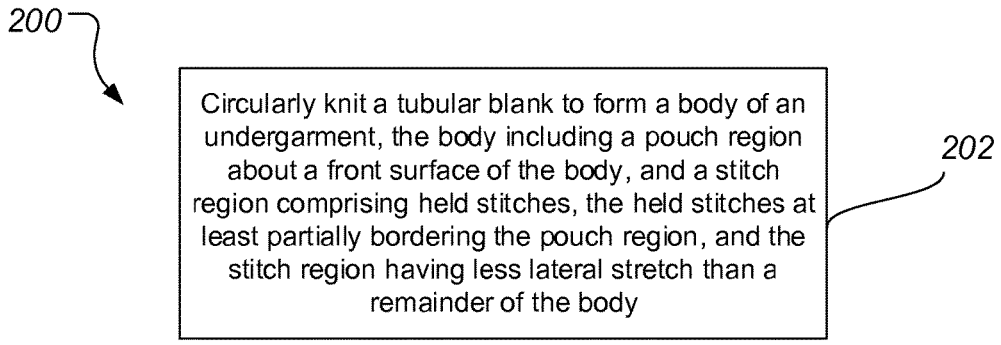
FIG. 3 is a flowchart of an example method of making an undergarment.

FIG. 3 is a flowchart describing an example method 200 of making an undergarment, for example, the example undergarment 100 of FIGS. 1 and 2. At 202, the a tubular blank is circularly knitted to form a body of an undergarment, where the body of the undergarment includes a pouch region about a front surface of the body, and a stitch region including held stitches, the held stitches at least partially bordering the pouch region, and the stitch region having less lateral stretch than a remainder of the body.

Figure 4:
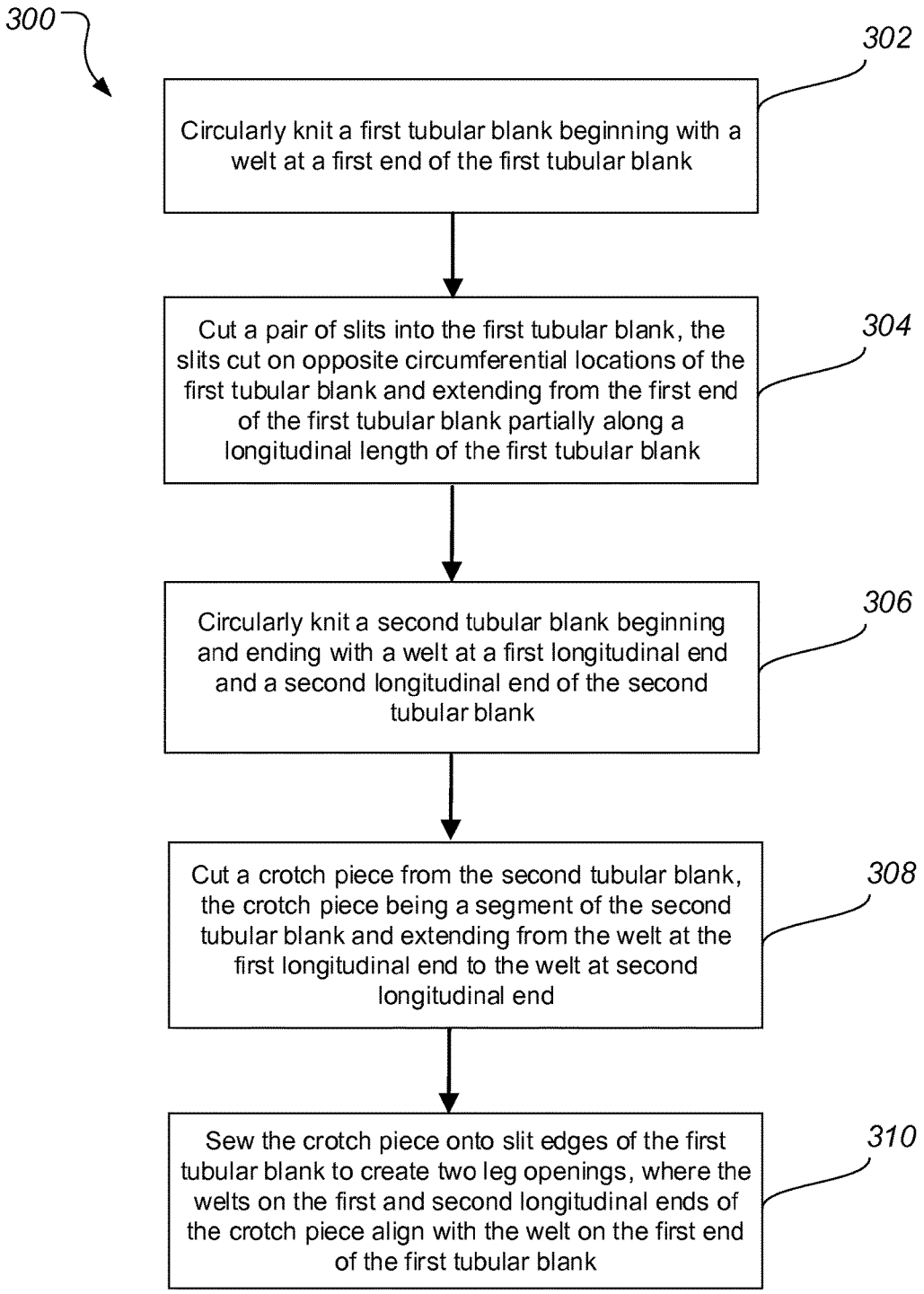
FIG. 4 is a flowchart of an example method of at least partially manufacturing an undergarment.

FIG. 4 is a flowchart describing an example method 300 of at least partially manufacturing an undergarment, for example, the example undergarment 100 of FIGS. 1 and 2. At 302, a first tubular blank is circularly knitted beginning with a welt at a first end of the first tubular blank. At 304, a pair of slits are cut into the first tubular blank, the slits cut on opposite circumferential locations of the first tubular blank and extending from the first end of the first tubular blank partially along a longitudinal length of the first tubular blank. At 306, a second tubular blank is circularly knitted beginning and ending with a welt at a first longitudinal end and a second longitudinal end of the second tubular blank. At 308, a crotch piece is cut from the second tubular blank, the crotch piece being a segment of the second tubular blank and extending from the welt at the first longitudinal end to the welt at second longitudinal end. At 310, the crotch piece is sewn onto slit edges of the first tubular blank to create two leg openings, where the welts on the first and second longitudinal ends of the crotch piece align with the welt on the first end of the first tubular blank.

A number of implementations have been described. Nevertheless, it will be understood that various modifications may be made without departing from the spirit and scope of the disclosure.

What is claimed is:

1. An undergarment, comprising:

a body having a substantially tubular shape and configured to at least partially surround a torso of a user, the body comprising:

a pouch region about a front surface of the body; and a stitch region comprising held stitches, the held stitches at least partially bordering the pouch region, the stitch region having less lateral stretch than a remainder of the body, wherein the stitch region comprises a first stitch area along a periphery of the pouch region and a second stitch area between the pouch region and the first stitch area, the second stitch area comprising the held stitches and having less lateral stretch than the first stitch area.

2. The undergarment of claim 1, wherein the body is formed from a circularly knit tubular blank.

3. The undergarment of claim 1, wherein the first stitch area comprises an outer stitch area and an inner stitch area, the inner stitch area having less lateral stretch than the outer stitch area.

4. The undergarment of claim 3, wherein the outer stitch area comprises a first rib structure, and wherein the inner stitch area comprises a second, wider rib structure.

5. The undergarment of claim 4, wherein the first rib structure of the outer stitch area comprises a 1×1 rib structure, and wherein the second rib structure of the inner stitch area comprises a 4×1 rib structure.

6. The undergarment of claim 1, wherein the second stitch area comprises a pattern of the held stitches to form fabric gathers in the pouch region adjacent the second stitch area.

7. The undergarment of claim 1, wherein the body comprises a first tubular leg portion and a second tubular leg portion substantially parallel to the first tubular leg portion, the first and second leg portions extending toward a first end of the body.

8. The undergarment of claim 7, wherein the first tubular leg portion comprises a first leg band knit into the first tubular leg portion at the first end of the body, and wherein the second tubular leg portion comprises a second leg band knit into the second tubular leg portion at the first end of the body.

9. The undergarment of claim 7, further comprising a waistband attached to the body at a second end of the body opposite the first end.

10. The undergarment of claim 7, further comprising a crotch piece sewn along inner slits of the first and second tubular leg portions and at least partially sewn along the stitch region and the pouch region.

11. The undergarment of claim 10, wherein the stitch region comprises a third stitch area between the crotch piece and the pouch region.

12. The undergarment of claim 11, wherein the third stitch area comprises a 1×1 rib structure.

13. An undergarment, comprising:

a body having a substantially tubular shape and configured to at least partially surround a torso of a user, the body comprising:

a pouch region about a front surface of the body;

a stitch region comprising held stitches, the held stitches at least partially bordering the pouch region, the stitch region having less lateral stretch than a remainder of the body; and a first tubular leg portion and a second tubular leg portion substantially parallel to the first tubular leg portion, the first and second leg portions extending toward a first end of the body; and a crotch piece sewn along inner slits of the first and second tubular leg portions and at least partially sewn along the stitch region and the pouch region.

14. The undergarment of claim 13, wherein the body is formed from a circularly knit tubular blank.

15. The undergarment of claim 13, wherein the stitch region comprises a first stitch area along a periphery of the pouch region and a second stitch area between the pouch region and the first stitch area, the second stitch area comprising the held stitches and having less lateral stretch than the first stitch area.

16. The undergarment of claim 15, wherein the first stitch area comprises an outer stitch area and an inner stitch area, the inner stitch area having less lateral stretch than the outer stitch area.

17. The undergarment of claim 16, wherein the outer stitch area comprises a first rib structure, and wherein the inner stitch area comprises a second, wider rib structure.

18. The undergarment of claim 17, wherein the first rib structure of the outer stitch area comprises a 1×1 rib structure, and wherein the second rib structure of the inner stitch area comprises a 4×1 rib structure.

19. The undergarment of claim 15, wherein the second stitch area comprises a pattern of the held stitches to form fabric gathers in the pouch region adjacent the second stitch area.

20. The undergarment of claim 13, wherein the first tubular leg portion comprises a first leg band knit into the first tubular leg portion at the first end of the body, and wherein the second tubular leg portion comprises a second leg band knit into the second tubular leg portion at the first end of the body.

21. The undergarment of claim 13, further comprising a waistband attached to the body at a second end of the body opposite the first end.

22. The undergarment of claim 13, wherein the stitch region comprises a third stitch area between the crotch piece and the pouch region.

23. The undergarment of claim 22, wherein the third stitch area comprises a 1×1 rib structure.

* * * * *